US009461375B2

(12) United States Patent
Yoshida et al.

(10) Patent No.: US 9,461,375 B2
(45) Date of Patent: Oct. 4, 2016

(54) CONNECTION TERMINAL

(71) Applicant: YAZAKI CORPORATION, Tokyo (JP)

(72) Inventors: Haruki Yoshida, Shizuoka (JP); Yoshitaka Tsushima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/428,471

(22) PCT Filed: Oct. 18, 2013

(86) PCT No.: PCT/JP2013/078364
§ 371 (c)(1),
(2) Date: Mar. 16, 2015

(87) PCT Pub. No.: WO2014/161798
PCT Pub. Date: Apr. 24, 2014

(65) Prior Publication Data

US 2015/0229047 A1 Aug. 13, 2015

(30) Foreign Application Priority Data

Oct. 19, 2012 (JP) ..... 2012-232027

(51) Int. Cl.

| | |
|---|---|
| ***H01R 9/24*** | (2006.01) |
| ***H01R 11/03*** | (2006.01) |
| ***H01R 11/09*** | (2006.01) |
| ***H01R 11/12*** | (2006.01) |

(Continued)

(52) U.S. Cl.
CPC ..... *H01R 11/03* (2013.01); *H01R 11/09* (2013.01); *H01R 11/12* (2013.01); *H01R 43/16* (2013.01); *H01R 4/34* (2013.01)

(58) Field of Classification Search
CPC ..... H01R 11/03
USPC ..... 439/345, 889, 883
See application file for complete search history.

(56) References Cited

U.S. PATENT DOCUMENTS 4,983,133 A * 1/1991 Van Scyoc ..... H01R 11/12 439/860
5,529,509 A * 6/1996 Hayes ..... H01R 11/12 439/288

(Continued)

FOREIGN PATENT DOCUMENTS

CN 1162199 A 10/1997
CN 102082332 A 6/2011

(Continued)

OTHER PUBLICATIONS

International Preliminary Report on Patentability and English language Written Opinion of the International Search Report for PCT/JP2013/078364.

(Continued)

*Primary Examiner* — Tulsidas C Patel
*Assistant Examiner* — Peter G Leigh
(74) *Attorney, Agent, or Firm* — Kenealy Vaidya LLP

(57) ABSTRACT

The present invention provides a connection terminal (1) which includes terminal members (2, 3) having cylindrical wire connecting parts (21, 31) to which conductors of electric wires are inserted and the conductors are electrically connected, and flat plate shaped attaching parts (22, 32) continuous to the wire connecting parts.

2 Claims, 6 Drawing Sheets

(51) Int. Cl.
*H01R 43/16* (2006.01)
*H01R 4/34* (2006.01)

(56) References Cited

U.S. PATENT DOCUMENTS 5,558,531 A * 9/1996 Ikeda ..... H01R 13/28 439/287
5,577,927 A * 11/1996 Okada ..... H01R 4/34 439/287
5,759,055 A * 6/1998 Colantuano ..... H01R 9/18 439/287
5,865,637 A * 2/1999 Shinozaki ..... H01R 11/12 439/287
6,476,325 B2 * 11/2002 Kondo ..... H01R 11/12 174/84 C
6,786,751 B2 * 9/2004 Maeda ..... H01R 11/12 439/287
7,125,295 B2 * 10/2006 Zhao ..... H01R 11/12 439/287
8,105,121 B2 * 1/2012 Miyamoto ..... H01R 4/646 439/883
8,202,102 B2 6/2012 Kim et al.
8,794,990 B2 * 8/2014 Deno ..... H01R 4/646 439/345
9,153,880 B2 * 10/2015 Omori ..... H01R 4/64
2004/0040734 A1 * 3/2004 Fujii ..... H01R 11/32 174/84 C
2013/0122731 A1 5/2013 Deno et al.

FOREIGN PATENT DOCUMENTS

CN 102668246 A 9/2012
JP 9-161872 A 6/1997
JP 2002-75490 A 3/2002
JP 2003-132969 A 5/2003
JP 2012-9384 A 1/2012
JP 2012-29512 A 2/2012
WO 2011/064639 A1 6/2011
WO WO 2012014687 A1 * 2/2012 ..... H01R 4/646

OTHER PUBLICATIONS

International Search Report and Written Opinion of the International Search Report for PCT/JP2013/078364 dated Jan. 14, 2014.
The extended European search report for the related European patent application No. 13847234.5 dated May 11, 2016.
Chinese Office Action for the related Chinese patent application No. 201380054727.1 dated May 4, 2016.
Japanese Office Action for the related Japanese patent application No. 2012-232027 dated May 31, 2016.

* cited by examiner (a)

(b)

(a)

(b)

(c)

(a)

(b)

(a)

(b)

(a)

(b)

CONNECTION TERMINAL

TECHNICAL FIELD

The present invention relates to a connection terminal electrically connected to an electric wire and more specifically to a connection terminal in which two terminal members, which are regarded as one set, are used in a state where they are superposed one on another.

BACKGROUND ART

Various kinds of electric wires have connection terminals (also referred simply to as terminals, hereinafter) connected to end parts of the electric wires and are connected to a device of a connection mate side through the terminals. Various kinds of terminals are suitably used depending on the kinds of the electric wires to be connected. For instance, in various kinds of vehicles such as motor vehicles, as electric wires for wiring electrical equipments, coaxial electric wires are widely employed. As one example of the terminal connected to such a coaxial electric wire, a terminal is known in which two terminal members, which are regarded as one set, are used in a state where they are superposed one on another (see Patent Literature 1). Each of the terminal members (referred to as a terminal fitting, hereinafter) includes a cylindrical wire connecting part to which a conductor (a braided wire or the like) of the coaxial electric wire is connected and a flat plate shaped attaching part which attaches the wire connecting part to a member to which the wire connecting part is attached. The wire connecting part covers an outer periphery of the conductor (a terminal part) which is exposed by peeling an outer sheath (an insulating coating) of the electric wire so as to accommodate therein, then, is crimped to attach and connect the wire connection part to the end part of the conductor. The attaching part has one outer edge connected to the wire connecting part and a hole part provided in a flat part, through which an attaching bolt for the member to which the wire connecting part is attached is allowed to pass.

Each of the terminal fittings is formed by applying a blanking or stamping work or a bending work to a metallic sheet having an electric conductivity. Specifically, the sheet is blanked or stamped so as to have an entire form obtained by expanding each terminal fitting. Then, a part of the blanked or stamped sheet is bent so as to have a cylindrical form, so that the wire connecting part is formed. On the other hand, another part of the blanked or stamped sheet is folded and bent to a flat plate shape, so that the attaching part is formed. Thus, the attaching part is formed in such a way that the flat plate shaped sheet is superposed so as to be continuous to the wire connecting part.

The two terminal fittings which form the terminal are superposed one upon another in a state where an engaging part provided in one terminal fitting is engaged with an engaged part provided in the other terminal fitting. For instance, a case will be described that on an attaching part of one terminal fitting (referred to as a lower terminal fitting, hereinafter), an attaching part of the other terminal fitting (similarly referred to as an upper terminal fitting, hereinafter) is mounted so that the terminal fittings are superposed one upon another. The engaging part of the lower terminal fitting is formed in such a way that a lower sheet (in an opposite side to a mounting side of the upper terminal fitting) of the superposed sheet which forms the attaching part is extended from one end edge of the sheet in parallel with the sheet and then, a tip end part is bent upward (toward the upper terminal fitting side). Then, in a base end of the tip end part, an opening (a through hole opened so as to pass through that part) is formed. The opening functions as the engaging part. On the other hand, the engaged part of the upper terminal fitting corresponds to the engaging part and is formed in such a way that an upper sheet (in an opposite side to the mounting side relative to the lower terminal fitting) of the superposed sheet which forms the attaching part is extended in parallel. Then, a tip end part as the engaged part is inserted into the opening of the lower terminal fitting as the engaging part. Thus, the engaged part can be engaged with the engaging part.

Further, the attaching part of each terminal fitting has a structure that the sheet is folded back and superposed so as to be formed in a flat plate shape. To the attaching part, a plurality of fixing pieces is provided and an edge of the attaching part is fixed by the fixing pieces. Since the fixing pieces are provided, the superposed part of the sheet is prevented from being opened in the attaching part. Namely, the attaching part is prevented from being opened. In this case, the fixing pieces are bent and crimped so as to grip the edge of the attaching part, so that the attaching part is prevented from being opened.

Then, the two terminal fittings are regarded as one set and the attaching parts are superposed one upon another so that mutual hole parts communicate with each other. The terminal fittings are fastened and fixed to an attached member, for instance, a vehicle body panel forming a vehicle body of the motor vehicle, more specifically, a weld nut provided in the vehicle body panel by a bolt passing through the communicating hole parts. At that time, in a state where an inclusively-fastening member is held between the bolt and the terminal fittings, for instance, the inclusively-fastening member is mounted on the upper terminal fitting of the terminal fittings superposed as the one set and the mounted inclusively-fastening member is fastened together with the upper terminal fitting and the lower terminal fitting by the bolt.

CITATION LIST

Patent Literature

Patent Literature 1: JP-A-2012-29512

SUMMARY OF INVENTION

Technical Problem

In the terminal having the above-described structure, when the two terminal fittings are superposed one upon another in a state where the engaging part provided in the lower terminal fitting is engaged with the engaged part provided in the upper terminal fitting, the engaging part is in a state that the tip end of the engaging part is located above a mount surface of the inclusively-fastening member in the upper terminal fitting. Accordingly, when the inclusively-fastening member is mounted on the mount surface of the upper terminal fitting, the inclusively-fastening member may interfere with the tip end of the engaging part. When the inclusively-fastening member interferes with the tip end of the engaging part at the time of mounting the inclusively-fastening member on the mount surface, an attitude of the inclusively-fastening member is not stabilized. Thus, the upper terminal fitting and the lower terminal fitting are attached to the attached member with difficulty.

Further, when the fixing pieces extended from the lower terminal fitting side are bent toward the upper terminal fitting on which the inclusively-fastening member is mounted and crimped on the mount surface of the inclusively-fastening member side in the upper terminal fitting, the mount surface is covered with the fixing pieces. Namely, in the mount surface, a part on the mount surface which is covered with the fixing pieces swells and does not form a flat surface. Accordingly, when the inclusively-fastening member is mounted on the mount surface, the inclusively-fastening member may interfere with the fixing pieces like the above-described tip end of the engaging part. As a result, when the inclusively-fastening member is mounted on the mount surface of the upper terminal fitting, the attitude of the inclusively-fastening member cannot be stabilized. Thus, the same situation may possibly arise that the terminal fittings are hardly attached to the attached member.

In order to avoid an interference with the inclusively-fastening member, the engaging part and the fixing pieces may be supposed to be arranged outside an area where the inclusively-fastening member is mounted on the mount surface. However, when the engaging part and the fixing pieces are arranged outside the area, the terminal fittings need to be increased in size. Thus, the terminal fittings are caused to be increased in size.

The present invention is devised by considering the above-described circumstances and it is an object of the present invention to provide a connection terminal which can avoid an interference with an inclusively-fastening member without increasing a size of a terminal member.

Solution to Problem

In order to solve the above problem, an aspect of the present invention provides a connection terminal including two terminal members which have hollow and tubular wire connecting parts to which conductors of electric wires are inserted and the conductors are electrically connected, and flat plate shaped attaching parts continuous to the wire connecting parts, wherein the two terminal members are configured such that the attaching part of the other terminal member is mounted on the attaching part of the one terminal member and an engaging part provided in the one terminal member is engaged with an engaged part provided in the other terminal member, the engaging part is extended from the attaching part of the one terminal member in parallel with the attaching part and a tip end part of the engaging part is bent toward the attaching part side of the other terminal member, the engaged part is extended from the attaching part of the other terminal member toward the one terminal member and a tip end part of the engaged part is bent to a direction separating from the attaching part so as to be parallel to the attaching part of the other terminal member, the engaging part has an opening formed in a base end of the tip end part of the engaging part to insert and engage the tip end part of the engaged part in the opening, and a tip end of the engaging part is located below the attaching part of the other terminal member.

According to this configuration, the tip end of the engaging part of the one terminal member is not located above the attaching part of the other terminal member. Accordingly, even when the inclusively-fastening member is mounted on the attaching part of the other terminal member, the inclusively-fastening member does not interfere with the tip end of the engaging part of the one terminal member. As a result, an attitude of the inclusively-fastening member mounted on the above-described mount surface can be stabilized. Thus, the terminal members can be smoothly attached to the attached member.

Another aspect of the present invention provides a connection terminal in which the two terminal members are configured such that a part of a sheet is bent in a tubular shape to form the wire connecting parts, and the other part of the sheet is folded and bent to superpose the sheet so as to form the attaching parts, in the attaching part of the other terminal member, a fixing piece is provided to fix an edge of the superposed sheet, and the fixing piece is extended from the edge of an upper side sheet of the superposed sheet located in an opposite side to the attaching part of the one terminal member and bent toward a lower surface of a lower side sheet of the superposed sheet to hold the other sheet by the one sheet.

According to this configuration, the fixing piece of the attaching part of the other terminal member is bent to the attaching part side of the one terminal. Thus, the fixing piece is not located above the attaching part of the other terminal member. Accordingly, even when the inclusively-fastening member is mounted on the attaching part of the other terminal member, the inclusively-fastening member does not interfere with the fixing piece. As a result, an attitude of the inclusively-fastening member mounted on the above-described mount surface can be stabilized. Thus, the terminal members can be smoothly attached to the attached member.

Advantageous Effects of Invention

According to the present invention, interference between the terminal member and the inclusively-fastening member can be avoided without increasing the size of the terminal member.

DESCRIPTION OF EMBODIMENTS

Now, a connection terminal (referred simply to as a terminal, hereinafter) according to the present invention will be described below by referring to FIG. 1 to FIG. 6(*b*). An electric wire to which the terminal of the present invention is connected has a structure including, for instance, an inner conductor, a first insulating coating (referred to as an inner insulator, hereinafter) with which the inner conductor is coated, an outer conductor provided coaxially with the inner conductor to surround an outer periphery of the inner insulator and a second insulating coating (similarly referred to as an outer insulator) with which the outer conductor is coated. Further, the electric wire may have a structure further including a shield conductor provided coaxially with the inner conductor and the outer conductor to surround an outer periphery of the outer insulator and a third insulating coating (referred to as a protection sheath, hereinafter) with which the shield conductor is coated. In this case, the inner conductor, the outer conductor and the shield conductor may respectively have arbitrary forms. For instance, the inner conductor may be formed as a stranded wire, the outer conductor may be formed as a stranded wire or a braided wire and the shield conductor may be formed as a braided wire or a foil. Further, the inner insulator, the outer insulator and the protection sheath may be formed with an insulating material (for instance, a resin of polyethylene, vinyl chloride, silicon or the like). The electric wire is used as an electric wire for wiring in a part (for instance, in an electrical equipment of a motor vehicle or the like) which needs to be shielded from an electromagnetic wave and formed as, what is called a coaxial electric wire. However, a use of the terminal according to the present invention is not limited to a terminal connected to the coaxial electric wire.

Figure 1:
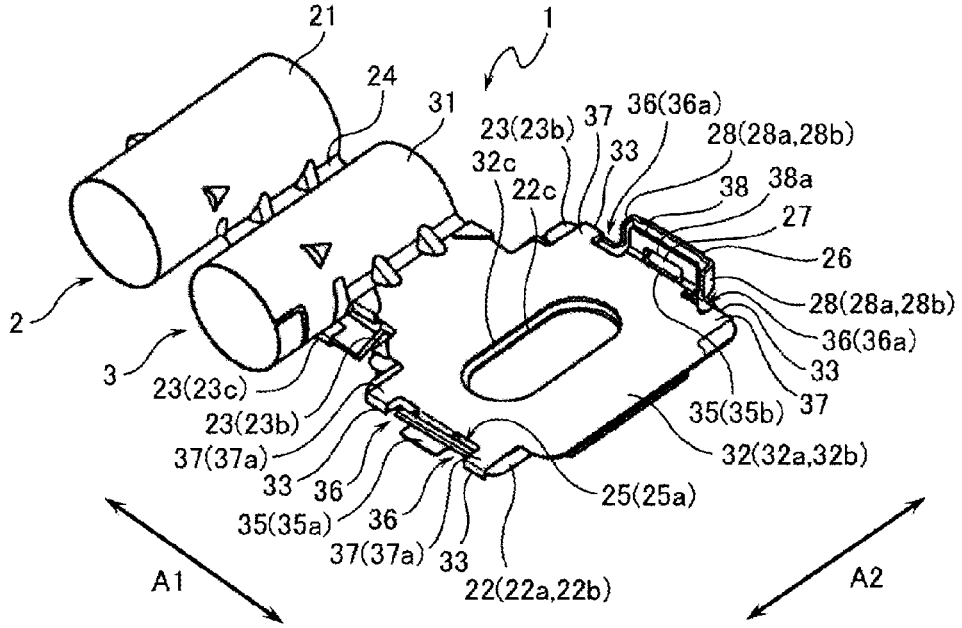
FIG. 1 is a perspective view showing an entire part of a connection terminal according to one embodiment of the present invention.
Figure 2:
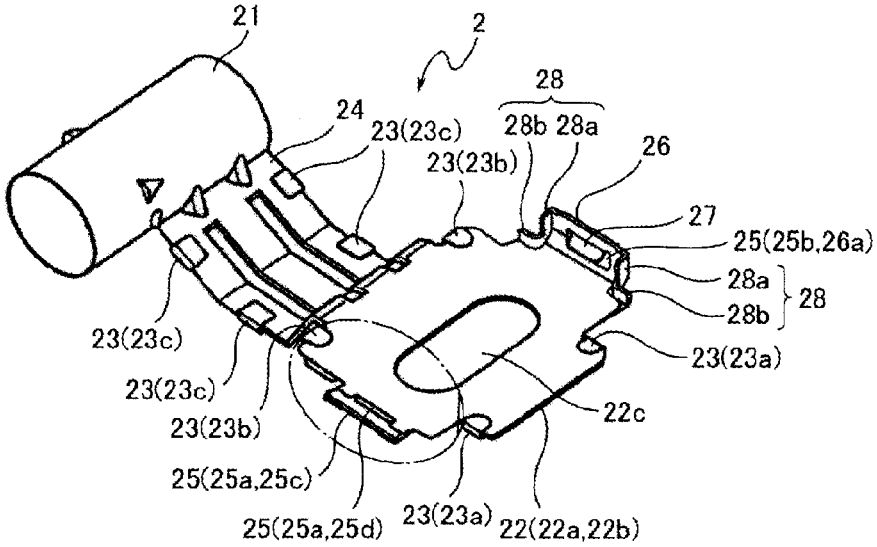
FIG. 2(*a*) and FIG. 2(*b*) are diagrams showing a structure of one of two terminal members (terminal fittings) forming the connection terminal, in which FIG. 2(*a*) is a perspective view showing an entire structure and FIG. 2(*b*) is an enlarged perspective view in a chain line circle shown in FIG. 2(*a*).
Figure 2:
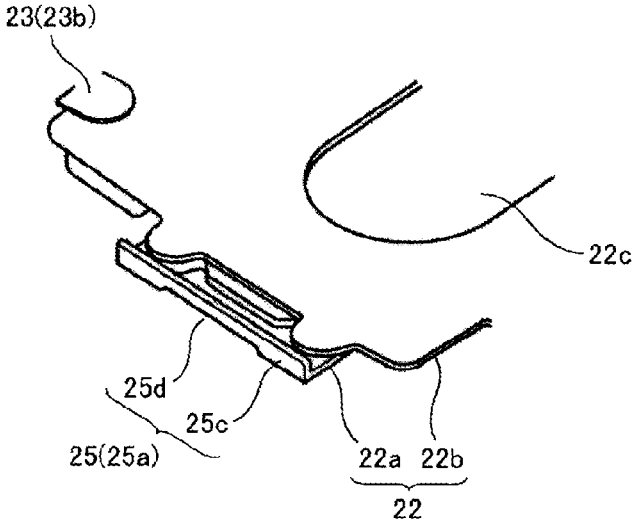
Figure 3:
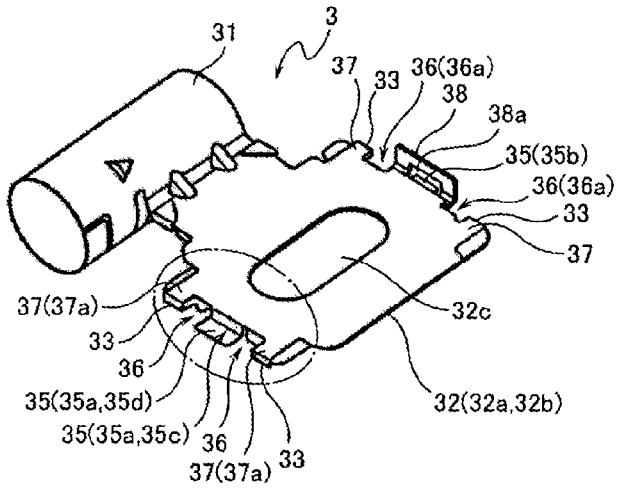
FIG. 3(*a*) to FIG. 3(*c*) are diagrams showing a structure of the other terminal member (a terminal fitting), in which FIG. 3(*a*) is a perspective view showing an entire structure, FIG. 3(*b*) is a perspective view showing an entire structure from an opposite side to FIG. 3(*a*) and FIG. 3(*c*) is an enlarged perspective view in a chain line circle shown in FIG. 3(*a*).
Figure 3:
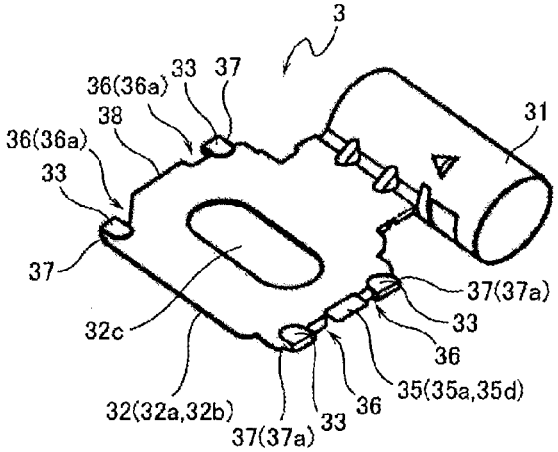
Figure 3:
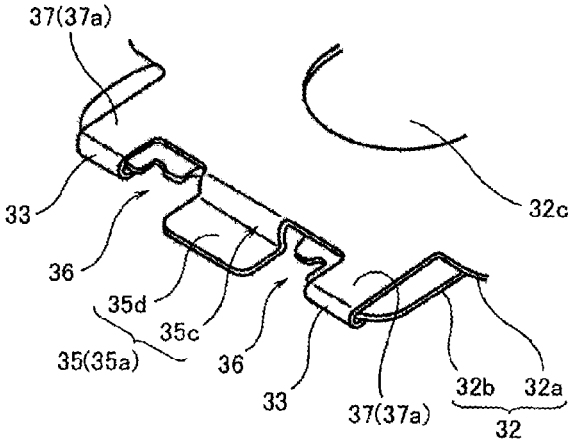

FIGS. 1 to 3(*c*) show a structure of the terminal according to one embodiment of the present invention. FIG. 1 is a perspective view showing an entire part of the terminal. FIG. 2(*a*) and FIG. 2(*b*) are diagrams showing a structure of one of two terminal members (referred to as terminal fittings, hereinafter) forming the terminal. FIG. 2(*a*) is a perspective view showing an entire structure and FIG. 2(*b*) is an enlarged perspective view in a chain line circle shown in FIG. 2(*a*). Further, FIG. 3(*a*) to FIG. 3(*c*) are diagrams showing a structure of the other terminal fitting. FIG. 3(*a*) is a perspective view showing an entire structure, FIG. 3(*b*) is a perspective view showing an entire structure from an opposite side to FIG. 3(*a*). FIG. 3(*c*) is an enlarged perspective view in a chain line circle shown in FIG. 3(*a*).

Figure 4:
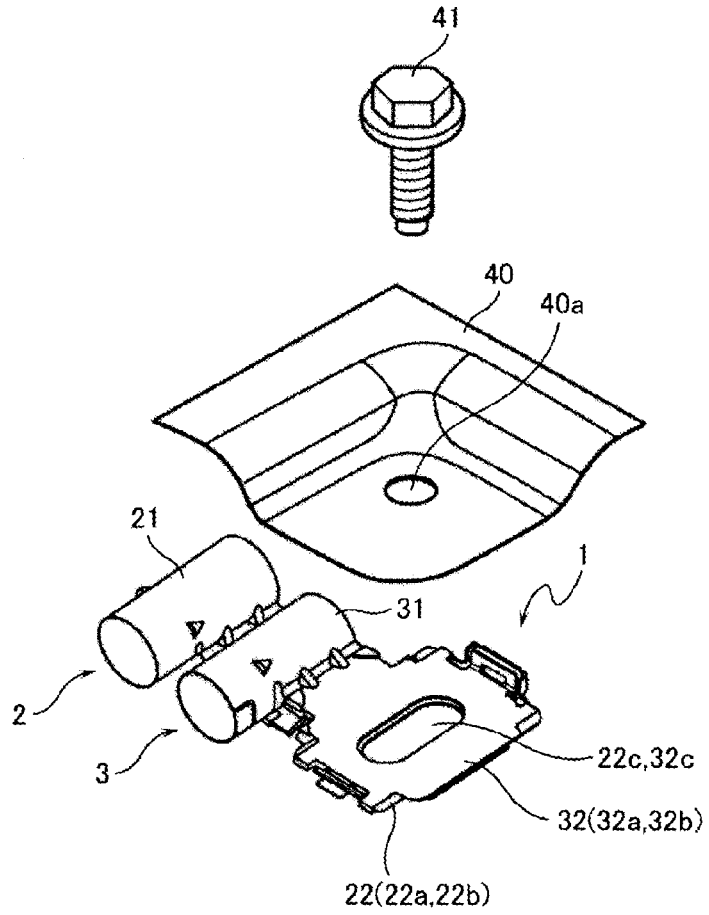
In FIG. 4(*a*) and FIG. 4(*b*), FIG. 4(*a*) is a perspective view showing a state before the terminal fittings are fastened together with an inclusively-fastening member and FIG. 4(*b*) is a perspective view showing a state after the terminal fittings are fastened together with the inclusively-fastening member.
Figure 4:
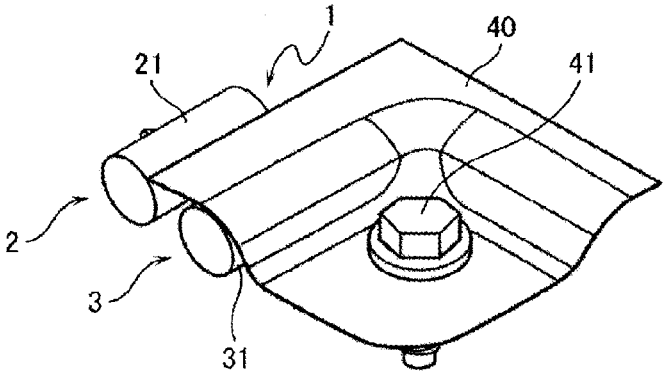

As shown in FIGS. 1 to FIG. 3(*c*), the terminal 1 according to the present embodiment is used in a state where the two terminal fittings 2 and 3 are superposed one upon another as one set. The terminal fittings 2 and 3 respectively include cylindrical wire connecting parts 21 and 31 to which the conductors (for instance, the stranded wires or the braided wires) of the electric wire (not shown in the drawing) are inserted and connected and flat plate shaped attaching parts 22 and 32 continuous to the wire connecting parts 21 and 31. The wire connecting parts 21 and 31 are attached to an attached member through the attaching parts 22 and 32. As long as the attached member is a member having a pedestal part which can hold the attaching parts 22 and 32 in stable attitudes, the attached member is not especially restricted. For instance, the attached member is a vehicle body panel forming a vehicle body of the motor vehicle, more specifically, a weld nut provided in the vehicle body panel. In this case, the two terminal fittings 2 and 3 are attached to the attached member in a state where the terminal fittings 2 and 3 are superposed one upon another so as to mount a part of the other terminal fitting (corresponding to a below-described attaching part 32 of the terminal fitting 3 in FIG. 1) on a part of the one terminal fitting (corresponding to a below-described attaching part 22 of the terminal fitting 2 in FIG. 1). Further, in the present embodiment, as shown in FIG. 4(*a*) and FIG. 4(*b*), an inclusively-fastening member 40 is further mounted on the two terminal fittings 2 and 3 (specifically, the attaching part 32). The inclusively-fastening member 40 is fastened together with the terminal fittings 2 and 3 (more specifically, the attaching parts 22 and 32) by a bolt 41 and attached to the attached member. FIG. 4(*a*) is a perspective view showing a state before the terminal fittings 2 and 3 are fastened together with the inclusively-fastening member 40 and FIG. 4(*b*) is a perspective view showing a state after the terminal fittings 2 and 3 are fastened together with the inclusively-fastening member 40.

The terminal fittings 2 and 3 shown in FIGS. 1 to FIG. 3(*c*) are formed by applying a blanking or stamping work or a bending work to a metallic sheet having an electric conductivity. Specifically, the sheet is blanked or stamped so as to have an entire form obtained by expanding the terminal fittings 2 and 3. Then, a part of the blanked or stamped sheet is bent so as to have a cylindrical form, so that the wire connecting parts 21 and 31 are formed. On the other hand, another part of the blanked or stamped sheet is folded and bent to have a flat plate shape, so that the attaching parts 22 and 32 are formed. Thus, the attaching parts 22 and 32 are formed in such a way that the flat plate shaped sheet is superposed so as to be continuous to the wire connecting parts 21 and 31. In a below-described explanation, parts located in a lower side (the terminal fitting 2 side in the terminal 1) of the superposed sheets which form the attaching parts 22 and 32 are referred to as attaching parts 22*a* and 32*a*. Parts located in an upper side (the terminal fitting 3 side in the terminal 1) are referred to as attaching parts 22*b* and 32*b*. Further, in a below-described explanation, a direction (a direction shown by an arrow mark A1 in FIG. 1) that the wire connecting parts 21 and 31 are continuous to the attaching parts 22 and 32 is called a longitudinal direction. A direction (a direction shown by an arrow mark A2 in FIG. 1) which intersects at right angles to the continuous direction (the longitudinal direction) on a plane formed by attaching parts 22 and 32 is called a transverse direction. However, the vertical direction, the longitudinal direction and the transverse direction do not necessarily need to correspond to directions (for instance, a vertical direction, a longitudinal direction or a transverse direction of the motor vehicle) respectively in a state that the terminal 1 is actually used.

The wire connecting parts 21 and 31 cover the conductors exposed by peeling the insulating coatings of the electric wires, for instance, terminal parts of the outer conductors exposed by peeling the outer insulators so as to accommodate therein, and are crimped so as to reduce diameters in this state. Thus, the wire connecting parts 21 and 31 are attached under pressure to the terminal parts of the outer conductors and electrically connected thereto. In the electric connecting parts 21 and 31, inside diameters of the cylindrical parts before the wire connecting parts are crimped are set to be larger than outside diameters of the terminal parts of the outer conductors. Thus, the wire connecting parts 21 and 31 are inserted to outer peripheries of the terminal parts of the outer conductors so that the terminal parts of the outer conductors may be covered with the electric connecting parts 21 and 31. Further, the wire connecting parts 21 and 31 which accommodate the terminal parts of the outer conductors therein are crimped, so that the wire connecting parts 21 and 31 are attached under pressure to the terminal parts of the outer conductors and the outer conductors can be electrically connected to the wire connecting parts 21 and 31. Since the wire connecting parts 21 and 31 may be formed in the cylindrical shapes corresponding to the outside diameters of the conductors of the electric wires (the terminal parts of the outer conductors, as one example), they may be formed in the cylindrical shapes having the same inside diameters or formed in the cylindrical shapes having different inside diameters.

In the attaching parts 22 and 32, are provided fixing pieces 23 and 33 which fix edges of the superposed sheet (namely, the attaching parts 22*a* and 32*a*, and the attaching parts 22*b* and 32*b*). These fixing pieces 23 and 33 are folded back toward the other outer edges of the attaching parts 22*a* and 32*a* or the attaching parts 22*b* and 32*b*, so that the attaching parts 22*a* and 32*a* and the attaching parts 22*b* and 32*b* are integrally fixed. In such a way, the superposed part (the attaching parts 22*a* and 32*a* and the attaching parts 22*b* and 32*b*) of the sheet is prevented from opening.

Further, in the attaching parts 22 and 32, hole parts 22*c* and 32*c* are formed which pass through parts near central parts thereof in the direction of thickness. As one example, the hole parts 22*c* and 32*c* are formed in the configurations of slots. Thus, as described below, when the terminal fittings 2 and 3 are attached to the attached member (as one example, the weld nut provided in the vehicle body panel), even if an error (a shift in an arranged position of the weld nut) occurs in the pedestal part of the attached member, or even if an error (a shift) in a position of a bolt insert hole 40*a* of the inclusively-fastening member 40 occurs, such an error can be absorbed by the slot shaped hole parts 22*c* and 32*c*. Accordingly, an attaching operation which attaches the terminal fittings 2 and 3 to the attached member can be rapidly carried out.

In the present embodiment, the one terminal fitting 2 has a structure, as shown in FIG. 2(*a*), that the other end edge of the wire connecting part 21 in the transverse direction is continuous to one end edge of the attaching part 22 in the transverse direction through a below-described holding part 24. Further, the other terminal fitting 3 has a structure, as shown in FIG. 3(*a*), that the other end edge of the wire connecting part 31 in the transverse direction is continuous to one end edge of the attaching part 32 in the transverse direction. Relative positions of the wire connecting parts 21 and 31 and the attaching parts 22 and 32 in the transverse direction in the terminal fittings 2 and 3 are not limited to the structures shown in FIGS. 1 to 3(*c*) and may be arbitrarily set. For instance, conversely to the structures shown in FIGS. 2(*a*) to 3(*c*), the one end edges of the wire connecting parts 21 and 31 in the transverse direction may be continuous to the other end edges of the attaching parts 22 and 32 of the terminal fittings 2 and 3 in the transverse direction.

Further, the one terminal fitting 2 has the holding part 24 extending between the wire connecting part 21 and the attaching part 22. The holding part 24 is formed as an arm on which the wire connecting part 31 of the terminal fitting 3 is mounted in a state where the attaching parts are superposed one upon another so as to mount the attaching part 32 of the other terminal fitting 3 on the attaching part 22, namely, the two terminal fittings 2 and 3 are formed as one set. The holding part 24 is connected respectively to the wire connecting part 21 and the attaching part 22. When the sheet is folded to form the flat plate shaped attaching part 22, the sheet is superposed to have a flat plate shape at the same time. The holding part 24 is formed in such a way that a recessed part along a circumferential surface of the wire connecting part 31 is formed along a longitudinal direction of the wire connecting part 21 so that the wire connecting part 31 mounted thereon is arranged substantially in parallel with the wire connecting part 21 of the terminal fitting 2. The recessed part is located in an intermediate part in the longitudinal direction and formed by bending the holding part 24 along the longitudinal direction of the wire connecting part 21. In a below-described explanation, the sheet of the two superposed upper and lower sheets forming the holding part 24 which is located in a lower side (in an opposite side to a side on which the attaching part 32 (the terminal fitting 3) is mounted) is referred to as a lower side holding part, and the sheet located in an upper side (the side on which the attaching part 32 (the terminal fitting 3) is mounted) is referred to as an upper side holding part. Further, in the holding part 24, a plurality of fixing pieces 23 are extended from one outer edges of the lower side holding part or the upper side holding part as in the attaching part 22. These fixing pieces 23 are folded back toward the other outer edges of the lower side holding part or the upper side holding part. Thus, the lower side holding part and the upper side holding part are integrally fixed. In such a way, the superposed part of the sheet (namely, the lower side holding part and the upper side holding part) is prevented from opening.

In the terminal fittings 2 and 3, the fixing pieces 23 and 33 are extended from edges of one of the superposed sheets which form the fixing attaching parts 22 and 32 and the holding part 24 and bent so as to be superposed on the other sheet, so that the sheets are fixed to each other. In this case, the fixing pieces 23 and 33 are crimped so as to grip the edges of the attaching parts 22 and 32 and the holding part 24 to fix respectively the sheets, namely, the attaching parts 22*a* and 22*b*, the attaching parts 32*a* and 32*b* and the lower side holding part and the upper side holding part to each other.

In the structure shown in FIG. 2, the fixing pieces 23 (23*a* and 23*b*) of the terminal fitting 2 are extended from the edges in the longitudinal direction and the transverse direction of the one sheet (the attaching part 22*a*) located in the lower side of the superposed sheet forming the attaching part 22, namely, in the opposite side to a side on which the attaching part 32 (the terminal fitting 3) is mounted and bent and crimped so as to be superposed on the other sheet (the upper side attaching part 22*b* (in a side on which the attaching part 32 is mounted)). In such a way, the attaching parts 22*a* and 22*b* are fixed to each other. The fixing pieces 23*a* are continuous from the edges in the transverse direction of the attaching part 22*a* and bent and crimped from the transverse direction so as to be superposed on the attaching part 22*b*. Further, the fixing pieces 23*b* are continuous from the edges in the longitudinal direction of the attaching part 22*a* and bent and crimped from the longitudinal direction so as to be superposed on the attaching part 22*b*. Thus, the attaching part 22 has a structure that the attaching parts 22*a* and 22*b* are fixed to each other by the fixing pieces 23*a* and 23*b* from both the longitudinal direction and the transverse direction. In such a way, the fixing pieces 23 of the terminal fitting 2 are continuously bent and crimped from the edges in the transverse direction of the lower side holding part so as to be superposed on the upper side holding part, so that the lower side holding part and the upper side holding part are fixed to each other.

Further, in the structure shown in FIG. 3 (*b*), the fixing pieces 33 of the terminal fitting 3 are extended from the edges in the transverse direction of the one sheet (the attaching part 32*b*) located in the upper side of the superposed sheet forming the attaching part 32, namely, in the opposite side to a side to be mounted on the attaching part 22 (the terminal fitting 2) and bent and crimped so as to be superposed on the other sheet (the lower side attaching part 32*a* (in the side to be mounted on the attaching part 22)). In such a way, the attaching parts 32*a* and 32*b* are fixed to each other.

As described above, the superposed attaching parts 22*a* and 22*b*, and the lower side holding part and the upper side holding part are fixed together by the fixing pieces 23 (23*a*, 23*b*, 23*c*). Further, the attaching parts 32*a* and 32*b* are fixed to each other by the fixing pieces 33. Thus, the superposed sheets which form the attaching parts 22, 32 and the holding part 24 can be prevented from opening. As a result, the forms of the attaching parts 22 and 32 and the holding part 24 can be stabilized and durability and strength can be improved. Further, the attaching parts 22 and 32 and the holding part 24 in a state of a single item before the two terminal fittings 2 and 3 are attached to the attached member are prevented from opening. Accordingly, serviceability can be improved during an attaching operation of the terminal fittings 2 and 3 to the attached member.

Figure 5:
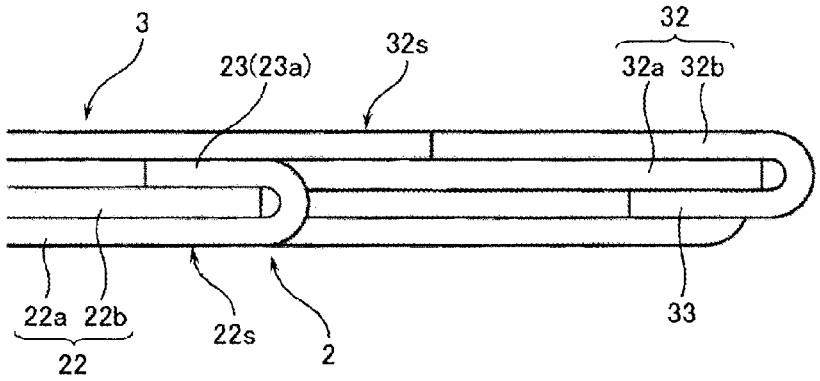
FIG. 5(*a*) and FIG. 5(*b*) show bent states of fixing pieces of attaching parts, in which FIG. 5(*a*) is a schematic view showing a state after the attaching part of the other terminal member is mounted on the attaching part of the one terminal member and before the inclusively-fastening member is mounted on the attaching part of the other terminal member, and FIG. 5(*b*) is a schematic view showing a state after the inclusively-fastening member is mounted on the attaching part of the other terminal member shown in FIG. 5(*a*).
Figure 5:
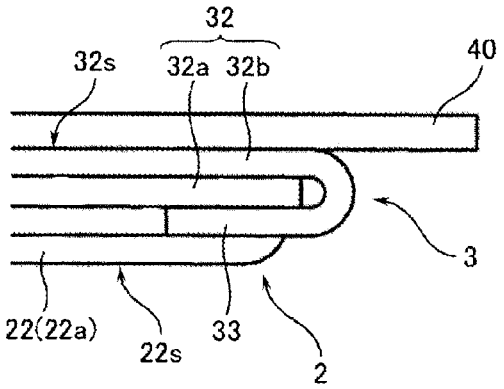

In addition thereto, the fixing pieces 23 and 33 are formed in such a way that when the attaching part 32 is mounted on the attaching part 22, the fixing pieces 23 and 33 are respectively bent and crimped toward opposed sides to each other, that is, the attaching part 22*b* side and the attaching part 32*a* side. FIG. 5(*a*) and FIG. 5(*b*) show bent states of the fixing piece 23 (23*a*) of the attaching 22 and the fixing piece 33 of the attaching part 32 in the present embodiment. FIG. 5(*a*) is a schematic view showing a state after the attaching part 32 is mounted on the attaching part 22 (the attaching part 22*b*) and before the inclusively-fastening member 40 is mounted on the attaching part 32 (the attaching part 32*b*). FIG. 5(*b*) is a schematic view showing a state that the inclusively-fastening member 40 is mounted on the attaching part 32 (the attaching part 32*b*) in FIG. 5(*a*). As shown in FIGS. 5(*a*) and 5(*b*), in the attaching part 22, the fixing piece 23(23*a*) is not superposed in the attaching part 22*a* side. Further, in the attaching part 32, the fixing piece 33 is not superposed in the attaching part 32*b* side. Namely, surfaces 22*s* and 32*s* of the attaching part 22*a* and the attaching part 32*b* are not allowed to swell by the fixing pieces 23 and 33 and can be formed to be flat. In the present embodiment, since the surface 32*s* of the attaching part 32*b* serves as a surface on which the inclusively-fastening member 40 is mounted, when the inclusively-fastening member 40 is fastened together with the terminal fittings 2 and 3, the inclusively-fastening member 40 does not interfere with the fixing piece 33. Thus, an attitude of the inclusively-fastening member 40 mounted on the surface 32*s* of the attaching part 32*b* can be stabilized and the terminal fittings 2 and 3 can be smoothly attached to the attached member (as one example, the weld nut of the vehicle body panel). Similarly, since the surface 22*s* of the attaching part 22*a* serves as an attaching surface to the attached member, when the terminal fittings 2 and 3 are attached to the attached member, the attached member does not interfere with the fixing pieces 23 (23*a*, 23*b*). Thus, an attaching operation can be smoothly carried out.

In the two terminal fittings 2 and 3, the attaching parts 22 and 33 are superposed one upon another so that the hole parts 22*c* and 32*c* communicate with each other and the terminal fittings 2 and 3 are attached to the attached member by an attaching member which is allowed to pass through the communicating hole parts 22*c* and 32*c*. In the present embodiment, one example of the attaching member is the bolt 41. The attaching parts 22 and 33 are fastened and fixed to the weld nut provided in the vehicle body panel by the bolt 41. At that time, the inclusively-fastening member 40 is mounted on the two terminal fittings 2 and 3 (specifically, the surface 32*s* of the attaching part 32) and fastened together with the attaching parts 22 and 33 by the bolt 41 which is allowed to pass through the bolt insert hole 41*a* which communicates with the hole parts 22*c* and 32*c*. Thus, a terminal process can be carried out, for instance, the outer conductors connected to the wire connecting parts 21 and 31 are grounded through the vehicle body panel.

The two terminal fittings 2 and 3 are superposed one upon another in a state where an engaging part 25 provided in the one terminal fitting 2 is engaged with an engaged part 35 provided in the other terminal fitting 3. In the terminal fitting 2, two engaging parts 25*a* and 25*b* are provided. In the terminal fitting 3, two engaged parts 35*a* and 35*b* are provided which can be respectively engaged with the engaging parts 25*a* and 25*b*. Specifically, the engaging part 25*a* and the engaged part 35*a* are provided so as to be engaged with each other. The engaging part 25*b* and the engaged part 35*b* are provided so as to be engaged with each other.

The one engaging part 25*a* of the terminal fitting 2 is extended from the attaching part 22 of the one terminal fitting 2 in parallel with the attaching part 22 and a tip end part is bent toward the attaching part 32 side of the other terminal fitting 3. Specifically, as shown in FIG. 2(*b*), the engaging part 25*a* is extended from the lower side (the opposite side to the side on which the attaching part 32 is mounted) attaching part 22*a* of the superposed sheet (the attaching parts 22*a*, 22*b*) which forms the attaching part 22 in parallel with the attaching part 22*a* from one end edge in the transverse direction of the attaching part 22*a*, and a tip end part thereof is substantially vertically bent upward (the attaching part 32 side). The engaging part 25*a* includes, in a base end of its tip end part (refer it to as a rising part, hereinafter) 25*c*, an opening (a through hole bored so as to pass through that part) 25*d* to which a below-described tip end part (a previously fitting part 35*d*) of the engaged part 35*a* is inserted and engaged. The rising part 23*c* is allowed to stand so that the tip end of the rising part 25*c* does not protrude more than the attaching part 32 of the terminal fitting 3 (specifically, the attaching part 32*b*). Namely, the tip end of the rising part 25*c* is designed so as to be located below the attaching part 32 of the other terminal member 3. A bending height of the engaging part 25*a* (a rising height of the rising part 25*c*) is set in such a way that the bending height or the rising height is substantially the same or a little lower than the surface 32*s* of the attaching part 32 (specifically, the upper side attaching part 32*b*) mounted on the attaching part 22 in the state where the engaging part 25*a* is engaged with the part t be engaged 35*a*.

The one engaged part 35*a* of the terminal fitting 3 is extended, correspondingly to the above-described engaging part 25*a*, from the attaching part 32 of the other terminal fitting 3 to the one terminal fitting 2 and a tip end part is bent toward a direction separating from the attaching part 32 so as to be parallel to the attaching part 32 of the other terminal fitting 3. Specifically, as shown in FIG. 3(*c*), the engaged part 35*a* has a structure that the engaged part 35*a* is substantially vertically extended downward from one end edge in the transverse direction of the upper side (the opposite side to the side to be mounted on the attaching part 22) attaching part 32*b* of the superposed sheet which forms the attaching part 32 (refer such a bent part to as a stepped part 35*c*, hereinafter) and the tip end part (referred to as the previously fitting part 35*d*, hereinafter) is bent toward the direction separating from the attaching part 32 so as to be parallel to the attaching part 32*b*. In both sides of the engaged part 35*a*, cut-out parts 36 are formed which are cut out along the transverse direction. Namely, the engaged part 35*a* (the stepped part 35*c* and the previously fitting part 35*d*) is disposed between the two cut-out parts 36 and also disposed between parts (protruding parts) 37 which are formed outside the cut-out parts 36 by forming the cut-out parts 36 and protrude in parallel with the attaching part 32*b*. A space (a space relative to the transverse direction) between the two protruding parts 37 (specifically, the protruding parts 37*a* shown in FIG. 1 and FIG. 3(*c*)) located at both sides with the engaged part 35*a* disposed between them is set to be slightly larger than a width (a dimension relative to the transverse direction) of the rising part 25*c* of the engaging part 25*a*. Namely, in a state where the attaching part 32 is superposed on the attaching part 22 so as to be mounted thereon so that the two terminal fittings 2 and 3 are formed as one set, these protruding parts 37*a* are formed so as to hold the rising part 25*c* of the engaging part 25 between both the sides in the transverse direction.

Figure 6:
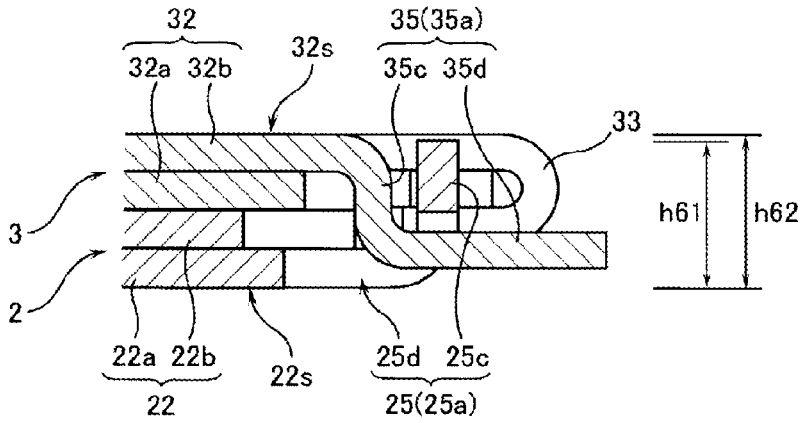
FIG. 6(*a*) and FIG. 6(*b*) are diagrams showing engaging states of an engaging part and an engaged part, in which FIG. 6(*a*) is a sectional view showing a state after the engaging part (a rising part and an opening) of the one terminal member is engaged with the engaged part (a stepped part and a previously fitting part) and before the inclusively-fastening member is mounted on the attaching part of the other terminal member, and FIG. 6(*b*) is a sectional view showing a state that the inclusively-fastening member is mounted on the attaching part of the other terminal member shown in FIG. 6(*a*).
Figure 6:
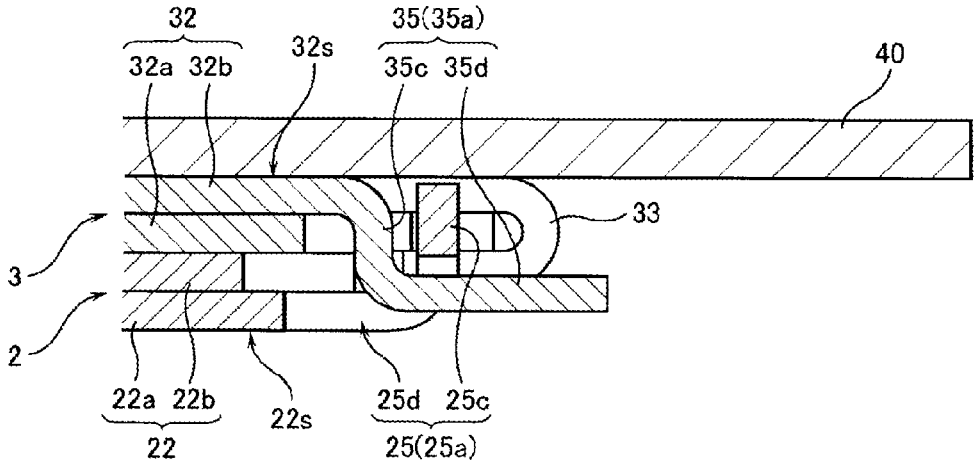

Thus, when the terminal fitting 3 is superposed on the terminal fitting 2 so as to mount the attaching part 32 on the attaching part 22 by inserting the engaged part 35*a* into the engaging part 25*a*, the engaged part 35*a* can be engaged with the engaging part 25*a*. FIG. 6(*a*) and FIG. 6(*b*) show engaging states of the engaging part 25*a* and the engaged part 35*a*. FIG. 6(*a*) is a sectional view showing a state after the engaging part 25*a* (the rising part 25*c* and the opening 25*d*) is engaged with the engaged part 35*a* (the stepped part 35*c* and the previously fitting part 35*d*) and before the inclusively-fastening member 40 is mounted on the attaching part 32 (the attaching part 32*b*). FIG. 6(*b*) is a sectional view showing a state that the inclusively-fastening member 40 is mounted on the attaching part 32 (the attaching part 32*b*) shown in FIG. 6(*a*). As shown in FIG. 6(*a*) and FIG. 6(*b*), the engaged part 35*a* is engaged with the engaging part 25*b* in such a way that the previously fitting part 35*d* is inserted into the opening 25*d* of the engaging part 25*a* and the stepped part 35*c* interferes with a peripheral edge of the opening 25*d*. When the engaged part 35*a* is allowed to be engaged with the engaging part 25*a*, for instance, the terminal fitting 3 is inclined relative to the terminal fitting 2 so that the previously fitting part 35*d* of the engaged part 35*a* may be inserted into the opening 25*d* of the engaging part 25*a*. From this state, while the previously fitting part 35*d* is inserted into the opening 25*d*, the previously fitting part 35*d* is pushed in to the opening 25*d* until the stepped part 35*c* of the engaged part 35*a* abuts on the rising part 25*c* of the engaging part 25*a*. Then, the terminal fitting 3 may be superposed on the terminal fitting 2 in such a way that the terminal fitting 3 is rotated so as to be parallel to the terminal fitting 2 by using the stepped part 35*c* as a supporting point and to mount the attaching part 32 on the attaching part 22.

In the present embodiment, as described above, in the state where the engaging part 25*a* is engaged with the engaged part 35*a*, specifically, the opening 25*d* interferes with the stepped part 35*c*, the bending height of the engaging part 25*a*, namely, the rising height of the rising part 25*c* (a distance h61 shown in FIG. 6(*a*)) is set to be substantially the same as or a little lower than a height of the attaching part 32 mounted on the attaching part 22 from the surface 22*s* of the attaching part 22*a* (specifically, as shown in FIG. 6(*a*), a distance h62 between the surface 32*s* of the upper side attaching part 32*b* and the surface 22*s* of the lower side attaching part 22*a*). As one example, FIG. 6(*a*) shows the structure that the bending height of the engaging part 25*a* (the rising height of the rising part 25*c*) h61 is set to be a little lower than a surface height (the distance h62 shown in FIG. 6(*a*)) of the surface 32*s* of the attaching part 32*b* (h61<h62). Namely, since a tip end of the rising part 25*c* does not swell more than the surface 32*s* of the attaching part 32*b*, a flat part of the surface 32*s* is not blocked by the rising part 25*c* and the surface 32*s* can be maintained to be in a flat state. Accordingly, as shown in FIG. 6(*b*), even when the inclusively-fastening member 40 is mounted on the surface 32*s* of the attaching part 32*b* as the mount surface, the inclusively-fastening member 40 does not interfere with the rising part 25*c*. Thus, an attitude of the inclusively-fastening member 40 mounted on the surface 32*s* of the attaching part 32*b* can be stabilized. As a result, the terminal fittings 2 and 3 can be smoothly attached to the attached member (as one example, the weld nut of the vehicle body panel). In the engaging part 25*a* and the engaged part 35*a*, an opening width or length (dimensions relative to the longitudinal direction and the transverse direction) of the opening 25*d* and a protruding width or length (dimensions relative to the same directions as described above) of the previously fitting part 35*d* may be set so that the engaging part 25*a* may be engaged with the engaged part 35*a* with sufficient engagement margins.

Further, in the present embodiment, the attaching part 22 of the one terminal fitting 2 has a bent part 26 formed by bending a part of the attaching part 22 relative to the other part. The bent part 26 is formed in the attaching part 22 by, for instance, a drawing work. The bent part 26 is provided in an end edge in an opposite side to the engaging part 25*a* with respect to the transverse direction of the attaching part 22. In the bent part 26, an opening 26*a* is formed as the other engaging part 25*b*. The bent part 26 has a structure that the other engaged part 35*b* provided in the attaching part 32 can be engaged with the opening 26*a*.

Specifically explained, as shown in FIG. 2(*a*), the bent part 26 is extended from the lower side (the opposite side to the side on which the terminal fitting 3 is mounted) attaching part 22*a* of the superposed sheet (the attaching parts 22*a* and 22*b*) which forms the attaching part 22. The bent part 26 is bent obliquely upward from the other end edge in the transverse direction of the attaching part 22*a*, and then, further bent so as to be substantially vertically elongated relative to the attaching part 22*a*. In the bent part 26, the opening (the through hole) 26*a* is formed which is bored in a part where a bending direction changes from the obliquely upward direction to the substantially vertical direction so as to pass through that part. The opening 26*a* functions as the engaging part 25*b*. Further, in the bent part 26, an engaging piece 27 which is inclined inside and extended downward from an upper end peripheral edge of the opening 26*a* is provided so as to close a part of the opening 26*a*. The engaging piece 27 is a blanked piece which is blanked or stamped when the opening 26*a* (the engaging part 25*b*) is formed, and is formed in such a way that the blanked piece is bent inward in a state where the blanked piece is connected to the upper end peripheral edge of the opening 26*a*.

Further, the attaching part 32 of the other terminal fitting 3 has a protection wall part 38 formed in such a way that a part of the attaching part 32 is bent in the same direction as that of the bent part 26 so as to be parallel to the bent part 26 relative to the other part. In the protection wall part 38, a protruding piece which protrudes toward the engaging part 25*b* (the opening 26*a* of the bent part 26) to be engaged with the engaging part 25*b* is provided as the engaged part 35*b*. As shown in FIG. 3(*a*), the protection wall part 38 is formed in such a way that the lower side (the side to be mounted on the attaching part 22) attaching part 32*a* of the superposed sheet which forms the attaching part 32 is protruded in parallel with the attaching part 32*a* from the other edge in the transverse direction of the attaching part 32*a*, and then, bent upward. The protection wall part 38 is formed in such a way that when the terminal fitting 2 and the terminal fitting 3 are superposed one upon another and the engaged part 35*b* is engaged with the engaging part 25*b* so that the attaching part 32 is mounted on the attaching part 22 (in this case, the engaged part 35*a* is also engaged with the engaging part 25*a* at the same time), a tip end thereof is located to protrude upward more than the bent part 26. Since protrusion height of the protection wall part 38 to the tip end of the bent part 26 (a difference of the protrusion height between the protection wall part 38 and the bent part 26) can be arbitrarily set depending on, for instance, a quality of material (a strength) or thickness of the terminal fittings 2 and 3, the protrusion height of the protection wall part is not especially specified herein. When the engaged part 35*b* is engaged with the engaging part 25*b*, the protection wall part 38 is located inside the bent part 26, in a different point of view, in a front side relative to a direction that the engaged part 35*b* is disengaged from the engaging part 25*b*. Since the protection wall part 38 is located as described above, an external force which allows the bent part 26 to be resiliently or elastically deformed so as to disengage the engaged part 35*b* from the engaging part 25*b* acts on the protection wall part 38 before the external force acts on the bent part 26. As a result, since an engagement of the engaged part 35*b* and the engaging part 25*b* is maintained, the engagement of the engaged part 35*b* and the engaging part 25*b* can be prevented from being released.

The protruding piece as the engaged part 35*b* is provided in the upper side (the opposite side to the side to be mounted on the attaching part 22) attaching part 32*b* of the superposed sheet which forms the attaching part 32 correspondingly to a position of the engaging part 25*b*. The protruding piece is formed to protrude from the other edge in the transverse direction of the attaching part 32*b* in parallel with the attaching part 32*b*. In this case, in both sides of the engaged part 35*b*, cut-out parts 36 are formed which are cut out along the transverse direction like the structure of the engaged part 35*a*. Namely, the engaged part 35*b* is disposed between the two cut-out parts 36. The engaged part 35*b* is formed so as to be disposed between the two cut-out parts 36. The engaged part 35*b* is disposed between the two cut-out parts 36 and also disposed between parts (protruding parts) 37 which are formed outside the cut-out parts 36 by forming the cut-out parts 36 and protrude in parallel with the attaching part 32*b*.

Further, the protection wall part 38 has an opening (a through hole) 38*a* bored in the bent part so as to pass through that part. The protection wall part 38 has a structure that the protruding piece as the engaged part 35*b* is allowed to pass through the opening 38*a* and face an outer part. In other words, the protection wall part 38 has a structure that the engaged part 35*b* is extended outward from the opening 38*a* so that the engaged part 35*b* may protrude toward the engaging part 25*b* (the opening of the bent part 26) so as to be engaged with the engaging part 25*b*.

Thus, when the terminal fitting 2 is superposed on the terminal fitting 3 so that the attaching part 32 is mounted on the attaching part 22 by inserting the engaged part 35*b* into the engaging part 25*b* (the opening 26*a* of the bent part 26*b*), the engaged part 35*b* can be engaged with the engaging part 25*b*. When the engaged part 35*b* is engaged with the engaging part 25*b*, for instance, the stepped part 35*c* of the above-described engaged part 35*a* is allowed to abut on the rising part 25*c* of the engaging part 25*a* and the terminal fitting 3 is rotated so as to be parallel to the terminal fitting 2 with the stepped part 35*c* used as the supporting point to insert the engaged part 35*b* into the engaging part 25*b*. At the same time, the engaging piece 27 of the bent part 26 is inserted into the opening 38*a* of the protection wall part 38. Then, the terminal fitting 3 is further rotated so that the terminal fitting 3 may be superposed on the terminal fitting 2 so as to mount the attaching part 32 on the attaching part 22. In this case, the engaging piece 27 is located in a state where the engaged part 35*b* is covered with the engaging piece 27, so that the engaging piece 27 can interfere with the engaged part 35*a*. In other words, the engaged part 35*a* is locked by the engaging piece 27. Further, in the state where the engaged part 35*b* is engaged with the engaging part 25*b*, as described above, the engaged part 35*a* is also engaged with the engaging part 25*a*. In the engaging part 25*b* (the opening 26*a* of the bent part 26) and the engaged part 35*b*, an opening width or length (dimensions relative to the longitudinal direction and the transverse direction) of the opening 26*a* as the engaging part 25*b*, a protruding width or length (dimensions relative to the same directions) of the protruding piece as the engaged part 35*b* and an extending width or length (dimensions relative to the same directions) of the engaging piece 27 may be set so that the engaging part 25*b* and the engaged part 35*b* may be engaged with each other with sufficient engagement margins.

In the present embodiment, since the protection wall part 38 is formed so as to correspond to the bent part 26, in the state where the attaching part 32 is superposed upon the attaching part 22 so as to mount the attaching part 32 on the attaching part 22 so that the two terminal fittings 2 and 3 are formed as the one set, the protection wall part 38 can protect the bent part 26 form the external force. Namely, for instance, when the external force acts on the terminal fitting 2 and 3, specifically, even when a force which is liable to resiliently deform the bent part 26 toward a direction that releases the engagement of the engaging part 25*b* with the engaged part 35*b*, such an external force initially acts on the protection wall part 38 and does not directly act on the bent part 26. In such a way, such an external force acts on the protection wall part 38, so that the external force can be prevented from being applied in a concentrated manner to the bent part 26 (especially, a tip end part) which gives a large influence to the engagement of the engaging part and the engaged part. Specifically, since the protection wall part 38 to which the external force is applied is resiliently deformed outward, the external force applied to the bent part 26 is exceptionally reduced. Accordingly, the bent part 26 can be restrained from being resiliently deformed outward, namely, toward a direction that releases the engagement of the engaging part 25*b* and the engaged part 35*b*. Thus, the engagement of the engaging part 25*b* (the opening 26*a* of the bent part 26) and the engaged part 35*b*, in another point of view, the engagement of the engaging piece 27 and the engaged part 35*b* is not broken and a sufficient engaged state can be ensured. Accordingly, the engaged state of the engaging part 25*b* and the engaged part 35*b* can be continuously maintained.

Further, in the present embodiment, the bent part 26 has a pair of rotation preventing parts 28 which are allowed to stand upright from the attaching part 22 of the one terminal fitting 2 so as to be able to interfere with both end edges of the parallel protection wall part 38. In other words, the attaching part 22 of the terminal fitting 2 has two rotation preventing parts 28 which are continuous so as to intersect respectively the attaching part 22 and the bent part 26. The rotation preventing parts 28 include holding part 28*a* which are respectively extended from both ends in the longitudinal direction of the bent part 26 toward the attaching part 22 along the transverse direction and abutting parts 28*b* which are further extended from the holding parts 28*a* along the longitudinal direction so as to be distant from each other. The holding part 28*a* formed in such a way as described above is provided so as to intersect the attaching part 22 and the bent part 26 respectively. Further, the abutting part 28*b* is provided so as to stand upright from the attaching part 22 and so as to be parallel to the bent part 26. These holding parts 28*a* and the abutting parts 28*b* are formed integrally with the bent part 26 at the same time when the bent part 26 is formed by a drawing work. In this case, the holding parts 28*a* are provided to stand upright from the attaching part 22 with substantially the same height as that of the bent part 26. The two holding parts 28*a* are provided at positions where the protection wall part 38 is disposed between the holding parts 28*a* when the attaching parts 22 and 32 are superposed one upon another. An opposed space (a space relative to the longitudinal direction) of the two holding parts 28*a* is set to be a little larger than a width (a dimension relative to the longitudinal direction) of the protection wall part 38. Thus, the holding parts 28*a* are formed in such a way that the holding parts 28*a* hold the protection wall part 38 from both sides in the longitudinal direction in the state where the attaching part 32 is superposed on the attaching part 22 so as to be mounted thereon to form the two terminal fittings 2 and 3 as one set. Further, the abutting parts 28*b* are lower than the bent part 26 and the holding parts 28*a* and allowed to stand upright with a height protruding from an upper surface of the attaching part 32 mounted on the attaching part 22. A length (a dimension relative to the longitudinal direction) of the abutting part 28*b* is set to be a little smaller than a width (a dimension relative to the same direction as described above) of the cut-out part 36 of the attaching part 32 (specifically, the cut-out part 36*a* shown in FIG. 1 and FIG. 3). Thus, the abutting parts 28*b* are formed in such a way that the abutting parts 28*b* enter the cut-out parts 36*a* to abut on the cut-out parts 36*a* in the state where the attaching part 32 is superposed on the attaching part 22 so as to be mounted on the attaching part 22 so that the two terminal fittings 2 and 3 are formed as the one set.

Since such rotation preventing parts 28 (the holding parts 28*a* and the abutting parts 28*b*) are provided in the attaching part 22, the rotation preventing parts 28 function as reinforcing ribs which reinforce rigidity of the bent part 26. Thus, the bent part 26, in other word, strength of the engaging part 25*b* can be improved. Accordingly, when the attaching parts 22 and 32 are attached to the attached member by the attaching member (for instance, the bolt) which is allowed to pass through the communicating hole parts 22*c* and 32*c* (as one example, fastened to the weld nut of the vehicle body panel by the bolt) or after the attaching parts 22 and 32 are attached (after fastened), even when the engaging part 25*b* interferes with the engaged part 35*b*, the engaging part 25*b* can be restrained from being resiliently deformed so as to collapse toward a direction that releases the engagement with the engaged part 35*b*. Especially, in the state where the attaching member 32 is superposed on the attaching part 22 so as to be mounted thereon to form the two terminal fittings 2 and 3 as the one set, the protection wall part 38 can be held from both the sides in the longitudinal direction by the holding parts 28*a* and the abutting parts 28*b* enter the cut-out parts 36*a* to abut on the cut-out parts 36*a*. Thus, for instance, even when the external force is applied to the terminal fittings 2 and 3, specifically, when such a force as to relatively rotate the terminal fittings 2 and 3 is applied to the terminal fittings 2 and 3, such an external force can be distributed and loaded to the holding parts 28*a* and the abutting parts 28*b*, and the protection wall part 38 and the cut-out parts 36*a*. Accordingly, the two terminal fittings 2 and 3 can be assuredly prevented from being relatively rotated by the external force.

As described above, in the terminal 1 (the terminal fittings 2 and 3) according to the present embodiment, since the fixing piece 33 of the attaching part 32 is bent from the attaching part 32*b* side to the attaching part 32*a* side, the fixing piece 33 does not swell from the surface 32*s* of the attaching part 32*b* and the surface 32*s* can be made to be flat. Further, when the bending height of the engaging part 25*a* (the rising height of the rising part 25*c*) h61 is set to be substantially the same as or a little lower than the surface height h62 of the surface 32*s* of the attaching part 32 (as one example, slightly lower), the flat part of the surface 32*s* is not blocked by the rising part 25*c* and the surface 32*s* can be maintained to be in a flat state.

Accordingly, in order to avoid an interference with the inclusively-fastening member 40, the fixing pieces 33 and the engaging part 25*a* do not need to be arranged outside an area on the surface 32*s* where the inclusively-fastening member 40 is mounted. Namely, the interference with the inclusively-fastening member 40 can be avoided without enlarging the terminal fittings 2 and 3. Thus, the terminal fittings 2 and 3 can be made to be compact and an attaching operation to the attached member can be efficiently carried out by fastening the terminal fittings 2 and 3 together with the inclusively-fastening member 40.

Further, since the bent part 26 and the protection wall part 38 are provided, an engagement of the engaging part 25*b* and the engaged part 35*b* can be prevented from being shallow or released. In addition thereto, since the attaching part 22 includes the rotation preventing parts 28 (the holding parts 28*a* and the abutting parts 28*b*), the relative rotation of the two terminal fittings 2 and 3 can be prevented. Thus, a positional shift preventing effect of the two terminal fittings 2 and 3 can be improved. Thus, the terminal fittings 2 and 3 can be continuously kept in their proper positions.

Now, features of the above-described embodiment of the connection terminal according to the present invention will be respectively briefly summarized and listed in the following configurations [1] and [2].

[1] A connection terminal (1) including two terminal members (2, 3) which have hollow and tubular wire connecting parts (21, 31) to which conductors of electric wires are inserted and the conductors are electrically connected, and flat plate shaped attaching parts (22, 32) continuous to the wire connecting parts, wherein the two terminal members are configured such that the attaching part (32) of the other terminal member (3) is mounted on the attaching part (22) of the one terminal member (2) and an engaging part (25*a*) provided in the one terminal member is engaged with an engaged part (35*a*) provided in the other terminal member, the engaging part is extended from the attaching part of the one terminal member in parallel with the attaching part and a tip end part (a rising part 25*c*) of the engaging part is bent toward the attaching part side of the other terminal member, the engaged part is extended from the attaching part of the other terminal member toward the one terminal member and a tip end part (a previously fitting part 35*d*) of the engaged part is bent to a direction separating from the attaching part so as to be parallel to the attaching part of the other terminal member, the engaging part has an opening (25*d*) formed in a base end of the tip end part of the engaging part to insert and engage the tip end part of the engaged part in the opening, and a tip end of the engaging part is located below the attaching part of the other terminal member.

[2] The connection terminal according to the configuration [1], wherein the two terminal members are configured such that a part of a sheet is bent in a tubular shape to form the wire connecting parts, and the other part of the sheet is folded and bent to superpose the sheet so as to form the attaching parts, in the attaching part of the other terminal member, a fixing piece (33) is provided to fix an edge of the superposed sheet, and the fixing piece is extended from the edge of an upper side sheet (an attaching part 32*b*) of the superposed sheet located in an opposite side to the attaching part of the one terminal member and bent toward a lower surface of a lower side sheet (an attaching part 32*a*) of the superposed sheet to hold the other sheet by the one sheet.

The present invention is described above in detail by referring to the specific embodiment. It is to be understood, however, to a person with ordinary skill in the art that various change or modifications may be added without deviating from the spirit and scope of the present invention.

This application is based on Japanese Patent Application No. 2012-232027 filed on Oct. 19, 2012, the contents of which are incorporated herein by reference.

INDUSTRIAL APPLICABILITY

According to the present invention, an interference with the inclusively-fastening member can be avoided without increasing the size of the terminal member. Thus, the connection terminal can be realized which makes it possible to miniaturize the terminal member and efficiently carry out an attaching operation to the attached member. The present invention which achieves the above-described effects is available for the field relating to the connection terminal connected to the electric wire.

REFERENCE SIGNS LIST

1: connection terminal
2, 3: terminal member (terminal fitting)
21, 31: wire connecting part
22, 32: attaching part
25 (25*a*): engaging part
25*c*: rising part
25*d*: opening
35 (35*a*): engaged part
35*d*: previously fitting part

The invention claimed is:

1. A connection terminal comprising:

first and second terminal members which have respective first and second hollow and tubular wire connecting parts configured to be electrically connected to conductors of respective electric wires when the conductors are inserted therein, and first and second flat plate shaped attaching parts continuous to the respective first and second wire connecting parts, wherein the first and second terminal members are configured such that the first attaching part of the first terminal member is mounted on the second attaching part of the second terminal member and a second engaging part provided in the second terminal member is engaged with a first engaged part provided in the first terminal member, the second engaging part is extended from the second attaching part of the second terminal member in parallel with the second attaching part and a second tip end part of the second engaging part is bent toward the attaching part side of the first terminal member, the first engaged part is extended from the first attaching part of the first terminal member toward the second terminal member and a first tip end part of the first engaged part is bent to a direction separating from the attaching part so as to be parallel to the first attaching part of the first terminal member, the second engaging part has a through hole formed in a base end of the second tip end part of the second engaging part to insert and engage the first tip end part of the first engaged part in the through hole, and a tip end of the second engaging part is located below the first attaching part of the first terminal member.

2. The connection terminal according to claim 1, wherein the first and second terminal members are configured such that a part of a sheet is bent in a tubular shape to form the first and second wire connecting parts, and the other part of the sheet is folded and bent to superpose the sheet so as to form the first and second attaching parts, in the first attaching part of the first terminal member, a fixing piece is provided to fix an edge of the superposed sheet, and the fixing piece is extended from the edge of an upper side sheet of the superposed sheet located in an opposite side to the second attaching part of the second terminal member and bent toward a lower surface of a lower side sheet of the superposed sheet to hold the lower side sheet by the upper side sheet.

* * * * *